US005454123A

United States Patent [19]

Barabino

[11] Patent Number: 5,454,123

[45] Date of Patent: Oct. 3, 1995

[54] ARRANGEMENT FOR AND METHOD OF AUTOMATICALLY CLEANING A SANITARY FIXTURE

[75] Inventor: Anchelito Barabino, Tortona, Italy

[73] Assignee: Strategic Technologies International Inc., Philadelphia, Pa.

[21] Appl. No.: 268,295

[22] Filed: Jun. 30, 1994

[30] Foreign Application Priority Data

Jan. 13, 1994 [IT] Italy ..... MI94A0027

[51] Int. Cl.[6] ..... E03C 1/126

[52] U.S. Cl. ..... 4/662; 4/233; 4/223

[58] Field of Search ..... 4/662, 233, 223, 4/224, 222, 300.2

[56] References Cited

U.S. PATENT DOCUMENTS

| | | | |
|---|---|---|---|
| 2,219,044 | 10/1940 | Horr | 4/233 |
| 2,605,478 | 8/1952 | Lassiter | 4/662 |
| 4,210,973 | 7/1980 | Decaux | 4/662 |
| 4,642,821 | 2/1987 | Zanuso et al. | 4/662 |
| 4,790,036 | 12/1988 | Vogeli et al. | 4/233 |
| 4,944,052 | 7/1990 | Wall | 4/662 |
| 5,022,098 | 6/1991 | Brower | 4/233 |

FOREIGN PATENT DOCUMENTS

| | | | |
|---|---|---|---|
| 2070480 | 12/1992 | Canada | 4/662 |
| 199682 | 10/1986 | European Pat. Off. | 4/662 |
| 2702788 | 9/1994 | France | 4/662 |
| 196399 | 3/1908 | Germany | 4/233 |

*Primary Examiner*—Henry J. Recla
*Assistant Examiner*—Charles R. Eloshway
*Attorney, Agent, or Firm*—Kirschstein et al.

[57] ABSTRACT

A toilet is automatically washed and dried after each use by a carriage mounted on a rear wall for translatory movement between a concealed, vandal-resistant position and an extended cleaning position.

16 Claims, 7 Drawing Sheets

ARRANGEMENT FOR AND METHOD OF AUTOMATICALLY CLEANING A SANITARY FIXTURE

BACKGROUND OF THE INVENTION

1. Field of the Invention

This invention generally relates to an arrangement for, and a method of, automatically washing and drying a sanitary fixture, e.g., a toilet, after each use.

2. Description of the Related Art

The owners of restaurants, hotels, service stations and like commercial establishments that offer a restroom on the premises for the convenience of their customers, as well as the owners of public restrooms where fees are collected for using the restrooms, have a continuous problem in maintaining the restrooms in a clean and sanitary condition and safeguarded from vandalism, primarily because of the unmonitored use and abuse of such restrooms by transients and patrons. Many systems have heretofore been proposed to rapidly and automatically clean such public use restrooms, but experience has shown that the expense and renovation required to implement such systems are impractical and have not led to vandal-free and sanitary restrooms.

SUMMARY OF THE INVENTION

It is an object of this invention to provide a vandal-resistant, arrangement for rapidly and automatically cleaning a sanitary fixture after each use.

Another object of this invention is to provide a sanitary arrangement for both public and commercial restrooms.

Still another object of this invention is to provide a rapid, automatic and sanitary cleaning of a sanitary fixture.

FEATURES OF THE INVENTION

In keeping with these objects, and others which will become apparent hereinafter, one feature of this invention resides in an arrangement for, and a method of, cleaning a sanitary fixture, e.g. a toilet, which comprises an upright, generally planar, rear wall spaced along a longitudinal direction rearwardly of the toilet, and a carriage mounted on the rear wall for reciprocal, translatory, linear movement along the longitudinal direction generally perpendicularly of the rear wall.

A washer is mounted on the carriage for joint movement therewith. When activated, the washer washes the toilet. A dryer is also mounted on the carriage for joint movement therewith. When activated, the dryer means dries the washed toilet.

A drive is provided for translatorily moving the carriage between a concealed position in which the washer and the dryer are concealed rearwardly of the rear wall, and an extended portion in which the carriage, the washer and the dryer are positioned above the toilet. Control circuitry is provided for sequentially activating the washer and the dryer during said translatory movement.

In a preferred embodiment, the carriage has a generally planar cover which is generally flush and co-planar with the rear wall in the concealed position.

In a public restroom, the rear wall typically partitions an enclosure into a usage zone in which a user enters, typically through a key-or coin-operated door, and a maintenance zone to which access by the user is denied. Advantageously, the carriage, the washer, the dryer, the drive and the control circuitry are all safely located, free from vandalism, behind the rear wall and the flush-mounted cover when the user is using the toilet. Only after the user is no longer using the toilet and, indeed, has exited the usage zone is the control circuitry activated to initiate cleaning. The translatory movement of the carriage, together with the rapid deployment of the washer and the dryer, insure rapid and efficient cleaning.

The novel features of the invention which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
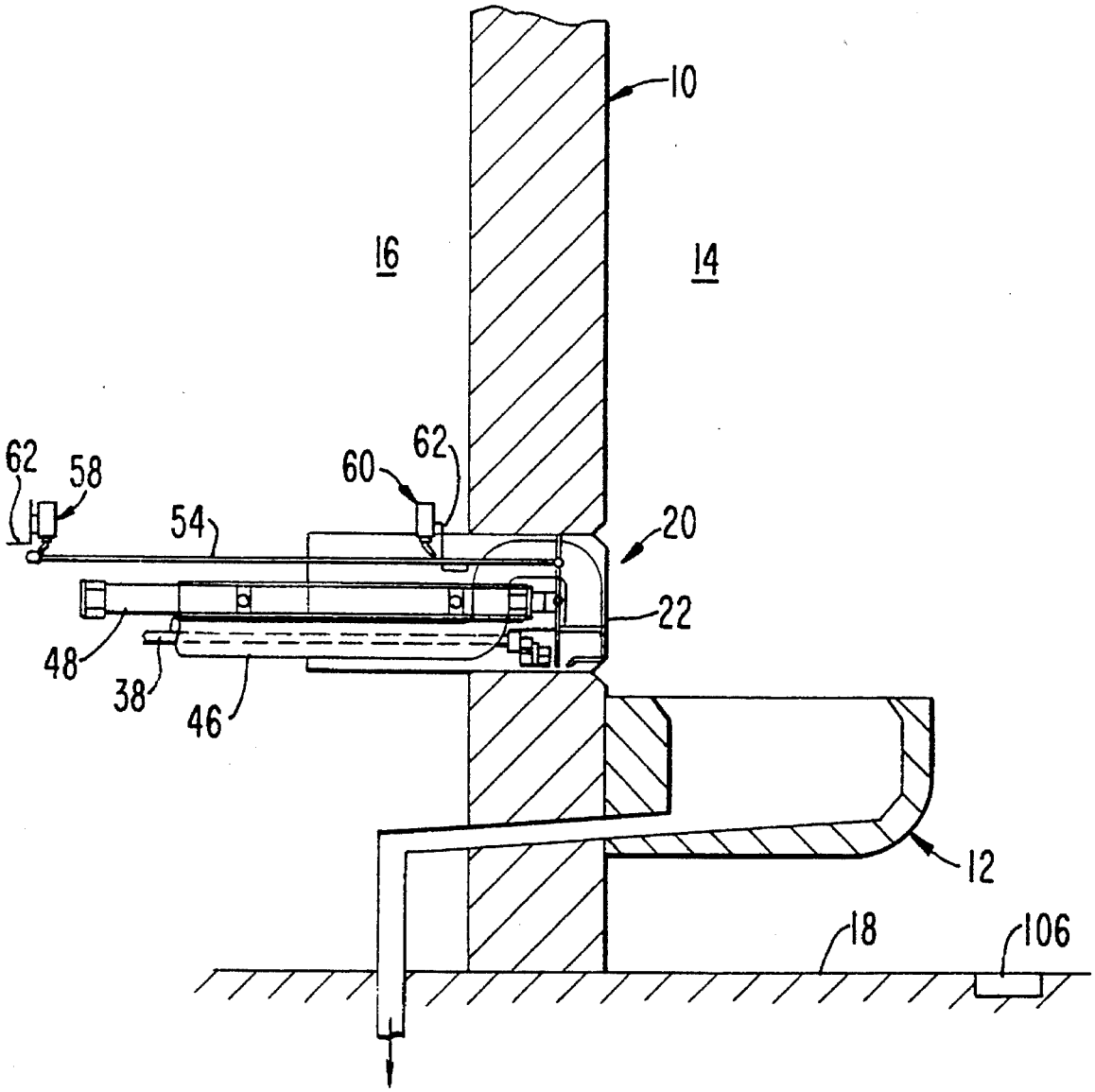
FIG.1 is a partly broken-away, partly sectioned, side elevational view of an automatic toilet cleaning arrangement in a concealed position in accordance with this invention.

Referring now to the drawings, reference numeral 10 generally identifies an upright, generally planar, rear wall spaced along a longitudinal direction rearwardly of a sanitary fixture, such as a toilet 12. Rear wall 10 partitions an enclosure or cubicle into a usage zone 14 into which a user is permitted access, typically through a non-illustrated but entirely conventional, key-or coin-operated door, and a maintenance zone 16 to which access to the user is denied. The usage zone 14 is also typically provided with other non-illustrated, conventional accessories such as a sink, a mirror, a light, a clothing hook, an exhaust fan and dispensers of water, soap, warm air and toilet paper. All of the components of the arrangement described herein, as will as other components, are mounted in the maintenance zone 16 safeguarded away from the user.

The toilet 12 may or may not have a seat and, indeed, the fixture can be any sanitary fixture which is desired to be cleaned, e.g. a bidet, a shower, a lavatory, a shower pan, etc. The fixture is typically designed for public use, e.g., made of metal, but could be made of other materials, particularly for private use. In the non-limiting case of a toilet, the toilet is either supported directly on a floor 18 of the cubicle or, as illustrated, is supported on the rear wall 10.

Figure 2:
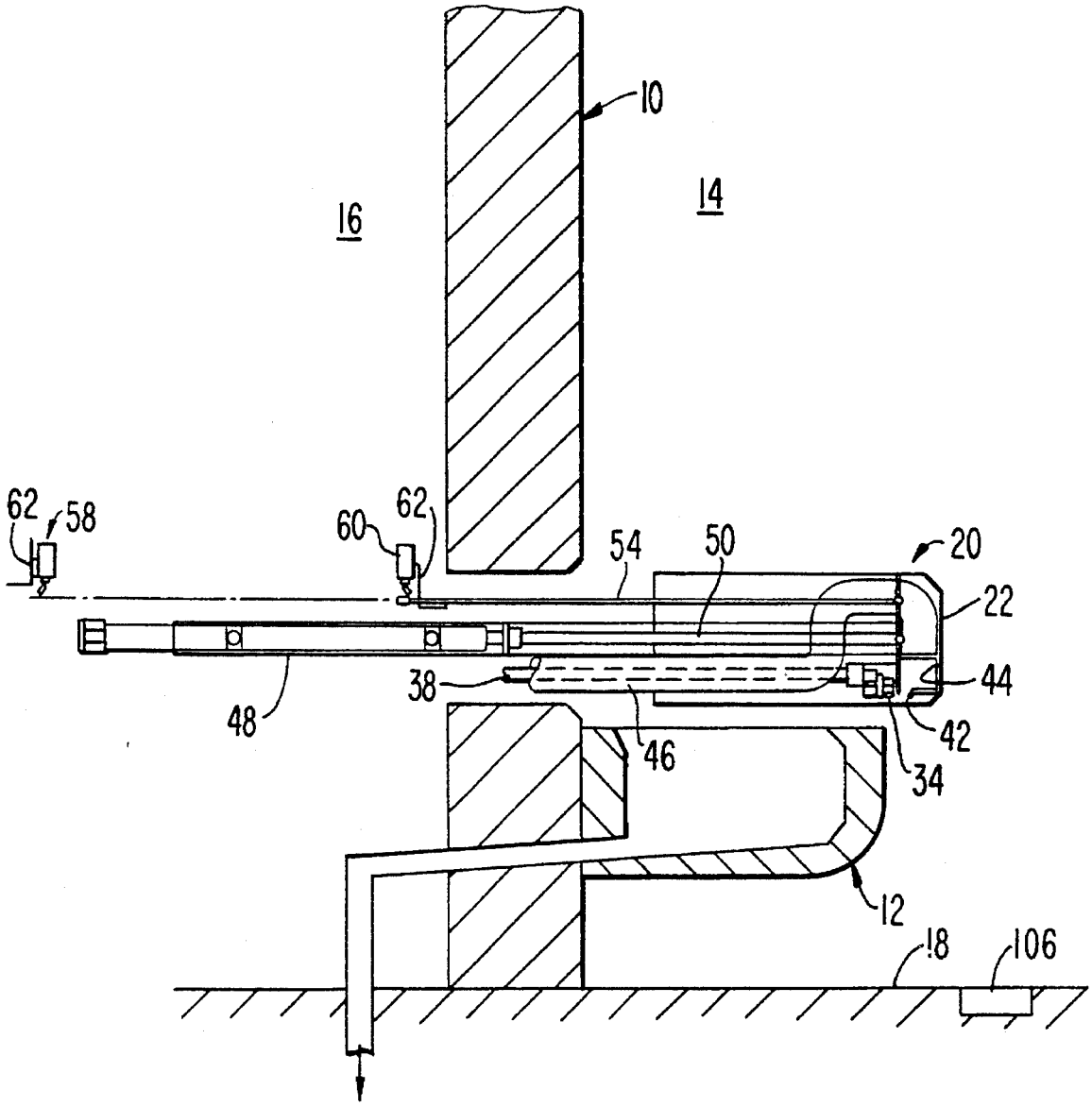
FIG. 2 is a view analogous to FIG. 1, but in an extended position.
Figure 3:
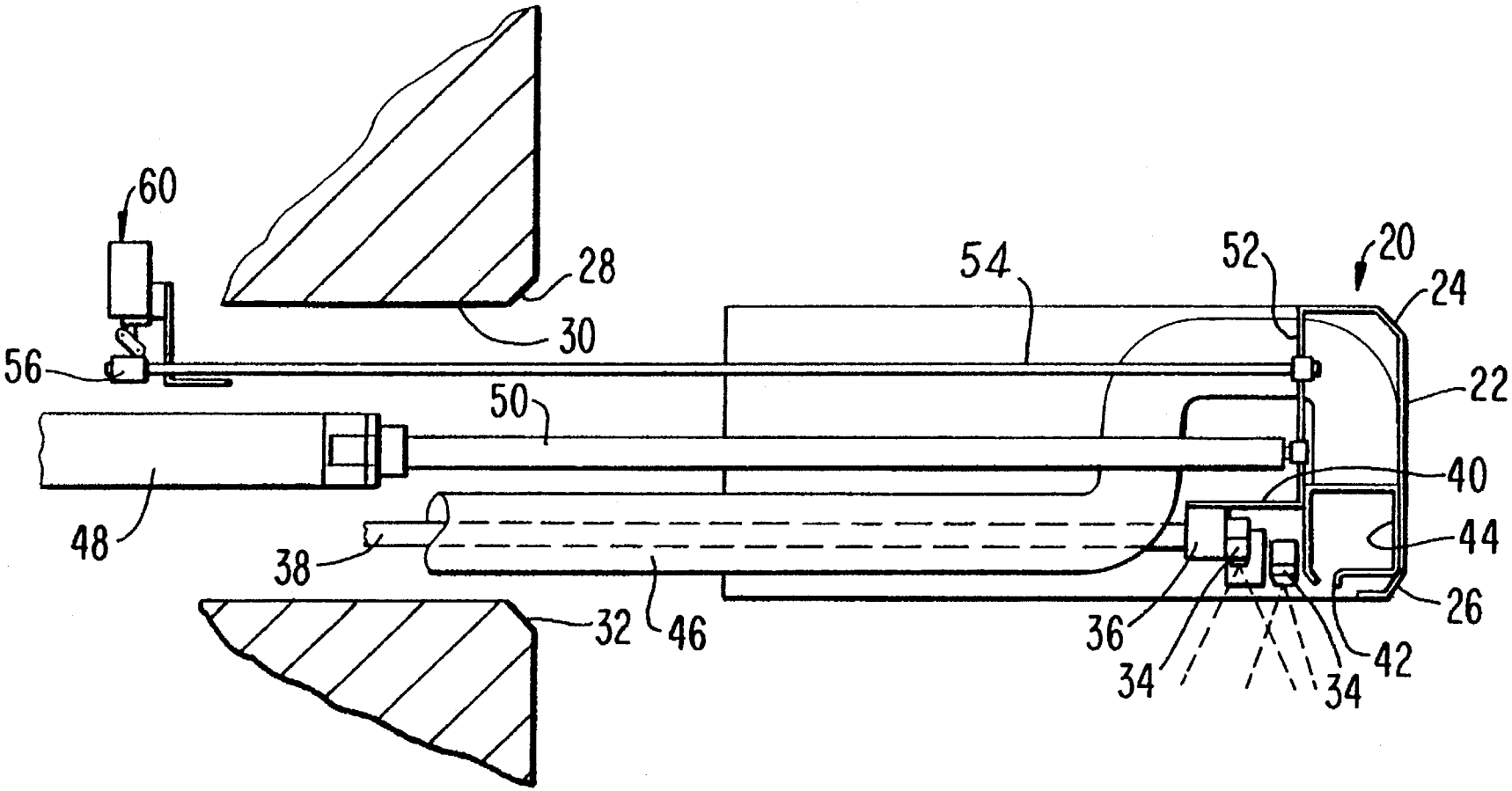
FIG. 3 is an enlarged view of a detail of FIG. 2.

In accordance with this invention, a carriage 20 is mounted on the rear wall for reciprocal, translatory, linear movement along the longitudinal direction generally perpendicularly of the rear wall 10 between a concealed position (FIG. 1) and an extended position (FIG. 2). As best shown in FIG. 3, the carriage 20 includes a generally planar, stainless steel, cover 22 that has upper and lower beveled edges 24, 26, as well as similarly beveled side edges. Returning to FIG. 1, the cover 22 is flush-mounted and co-planar with an outer surface of the rear wall 10 in the concealed position, thereby insuring that all components on the carriage are safeguarded from vandalism. The wall 10 has an opening 30 bounded by upper and lower beveled edges 28, 32 which cooperate with the beveled edges 24, 26, as well as peripheral beveled edges which cooperate with the side edges of the cover, to resist intruder entry.

Figure 4:
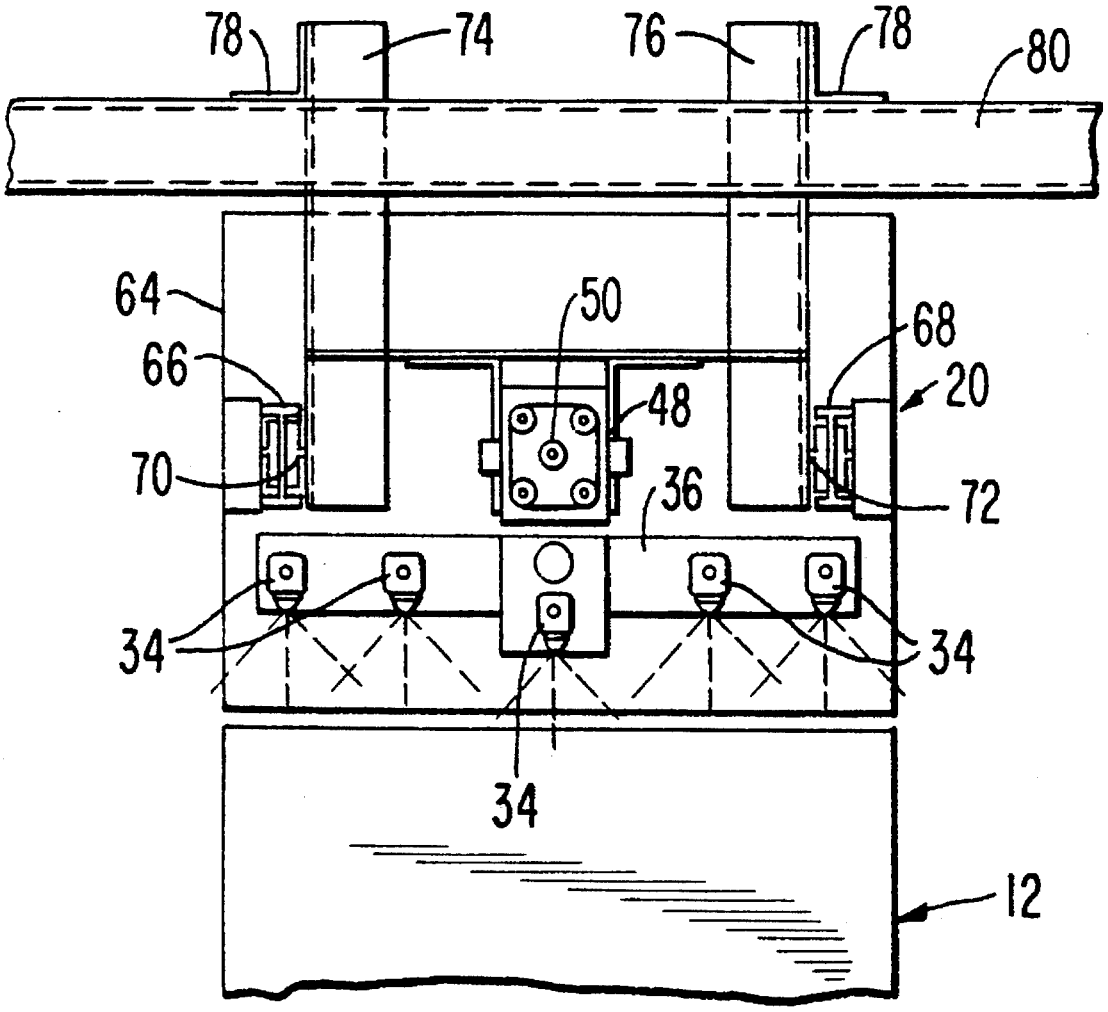
FIG. 4 is a front view of the detail of FIG. 3, but with a cover removed.

A washing assembly is mounted on the carriage 20 for joint movement therewith, and includes a plurality of spray nozzles 34 (see FIG. 4) mounted on a water manifold 36 to which a water hose 38 is hydraulically connected. The manifold 36 is mounted on the carriage by a bracket 40. Cleaning water from a non-illustrated water supply is pumped through the hose 38 and is forcefully ejected under a high pressure through the nozzles 34. A central one of the nozzles 34 is positioned forwardly of the others for not only washing the center of the toilet, but also, as shown in FIG. 2, for spraying its cleaning water at the exterior front of the toilet 12.

A drying assembly is also mounted on the carriage 20 for joint movement therewith, and includes an air nozzle 42 located at the bottom of an air manifold 44 to which a warm air duct 46 is connected. The manifold 44 is mounted behind the cover 22. Warm air from a non-illustrated air supply is pumped through the duct 46 into the manifold 44 and ejected forcefully under a high pressure through the air nozzle 42. The air nozzle 42 is a linear slot transversely extending along the width of the carriage, and emits a generally planar, air curtain to dry the washed toilet.

The carriage 20 is driven, by the control circuit of FIG. 5 described below, by a pneumatic piston 50 connected to a carriage wall 52 and received in a cylinder 48. A longitudinally-extending signalling arm 54 is also connected at one end to the carriage wall 52. A cam 56 at the opposite end of the arm 54 is used to trip either limit switch 58 (FIG. 1) to signal that the carriage is fully retracted in the concealed position, or limit switch 60 (FIG. 2) to signal that the carriage is fully extended in the extended position. The limit switches 58, 60 are mounted on support brackets 62 spaced apart along the longitudinal direction behind the wall 10.

The carriage itself, together with the washing and drying assemblies, are mounted on a frame 64 (FIG. 4) having a pair of support arms 66, 68 spaced transversely apart of each other and telescopingly mounted on guide rails 70, 72. The rails 70, 72 are supported in spaced-apart relation on upright posts 74, 76 which, in turn, are fixed by brackets 78 to a horizontal support 80. The arms 66, 68 slide on and along the rails 70, 72 during operation of the pneumatic drive cylinder-piston unit.

Figure 5:
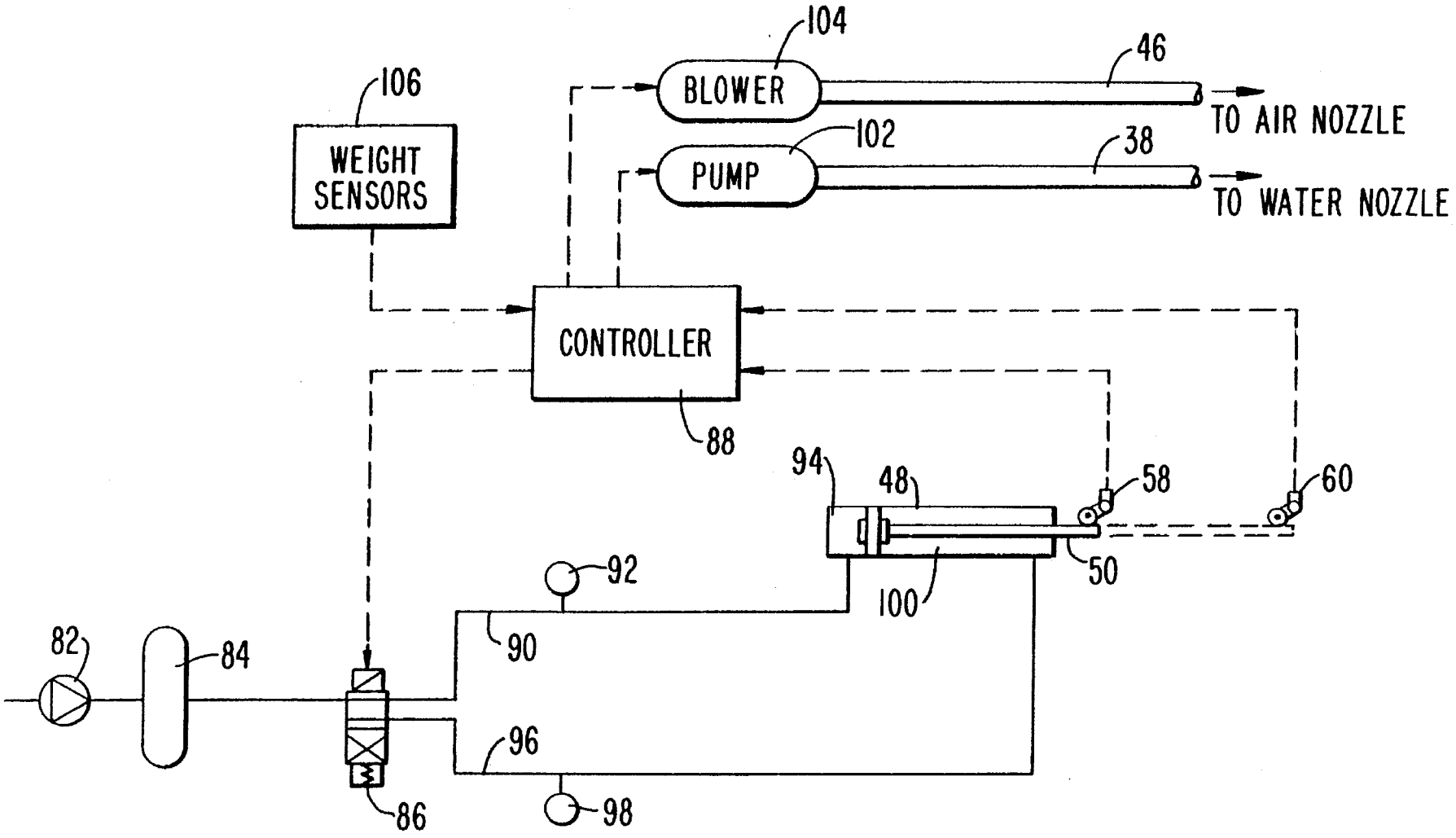
FIG. 5 is a pneumatic circuit diagram of a drive for the arrangement of FIG. 1.

Referring now to the control circuit of FIG. 5, a compressor 82 compresses ambient air and delivers the compressed air to a compressed air tank 84 in which it is stored. An electro-pneumatic valve 86 regulates the delivery of the compressed air under the control of a controller 88 along a first air line 90 past a backpressure sensor 92 to a compartment 94 in the pneumatic cylinder 48, and also along a second air line 96 past a backpressure sensor 98 to a compartment 100 in the cylinder 48. Air delivered to the compartment 94 causes the piston 50 to extend and, of course, the carriage to be advanced to the extended position. Air delivered to the compartment 100 causes the piston 100 to retract and, analogously, the carriage to be returned to the retracted position.

The controller 88, preferably a programmed microprocessor, accepts input signals from the switches 58, 60 to determine the position of the carriage, and generates output drive signals for the valve 86 to drive the carriage 20, an output washing signal to activate a water pump 102 to deliver pressurized water along hose 38 to the water nozzles 38, and an output drying signal to activate a warm air blower 104 to deliver warm air along duct 46 to the air nozzle 42.

Figure 6:
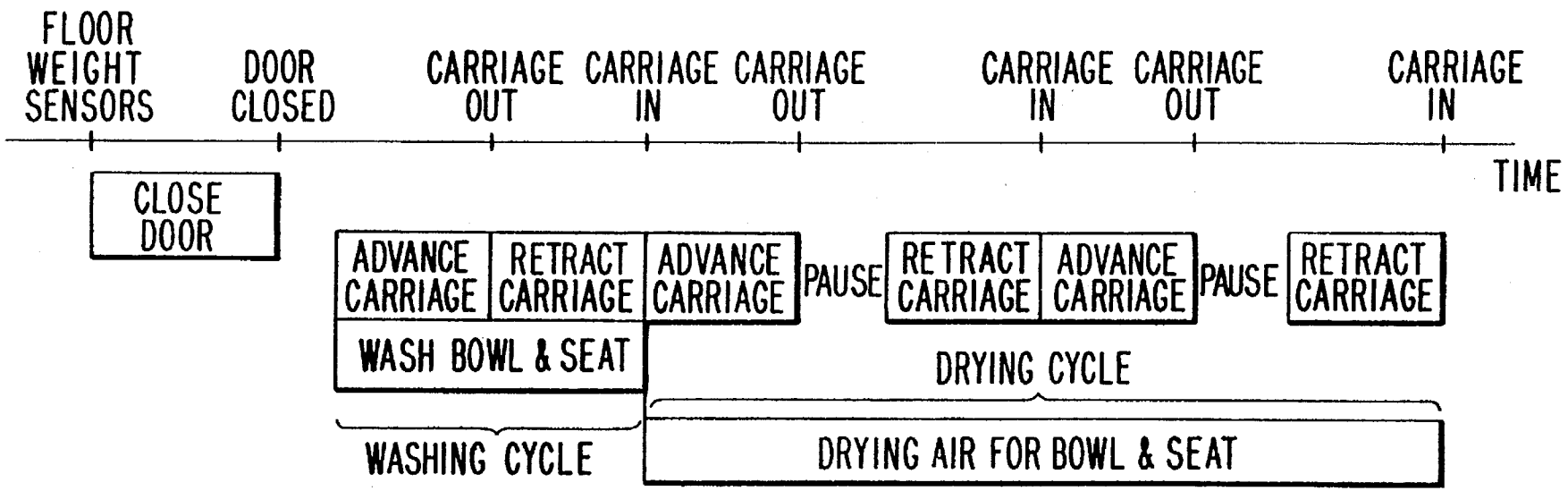
FIG. 6 is a process diagram of a cleaning cycle.

FIG. 6 is a timing diagram showing when the controller 88 initiates a cleaning cycle and a drying cycle. The user initiates operation of the microprocessor by opening the door to the cubicle, typically by depositing a coin, or inserting a key, into a designated area. This action triggers the controller 88 to open the door, turn on the lights, energize an exhaust fan, and starts a timer to limit the maximum time period in which the user can stay in the cubicle. For example, if the user stays beyond the maximum period, the door will automatically open, and an audible alarm will be sounded to discourage the user from remaining any longer in the cubicle.

Weight sensors 106 in the floor detect the user's presence. Upon such detection, the door is automatically closed. If no user is detected within a predetermined time, then the door is closed, and the microprocessor is reset to await another triggering action.

One or more buttons in the usage zone, upon manual activation by the user, flushes the toilet and opens the door. A cleaning cycle begins once the user has left the cubicle, as confirmed by the floor sensors 106. If the user has not left, then another audible alarm will be sounded, or a silent alarm will be reported to a monitoring station.

As shown in FIG. 6, once the door is closed, the washing cycle begins, followed by a drying cycle. During the washing cycle, the carriage is advanced, using a very low pressure, e.g., below ten atmospheres, to the extended position. Once confirmed by the limit switch 60, the carriage is returned to the retracted position, with confirmation being provided by the limit switch 58. During this back-and-forth movement, the water pump 102 has been activated, thereby causing water to be sprayed at the toilet by the nozzles 34. The sprayed water flows through the toilet bowl into the sewer line. Any water on the floor is collected by gravity drains.

Next, the drying cycle is initiated and, as shown, two back-and forth movements of the carriage, together with a short pause at the extended position, constitute the drying cycle during which time the warm air blower 104 has been activated, thereby causing warm air to be ejected from the nozzle 42 at the wet toilet to dry the same.

It is also within the spirit of this invention to change the number and order of the washing and drying cycles, as well as the number and position of the water nozzles. In another variant, rather than using a separate air nozzle, one or more of the water nozzles could also be connected to a pressurized air supply and switched, when appropriate, to deliver warm air, rather than water.

Figure 7:
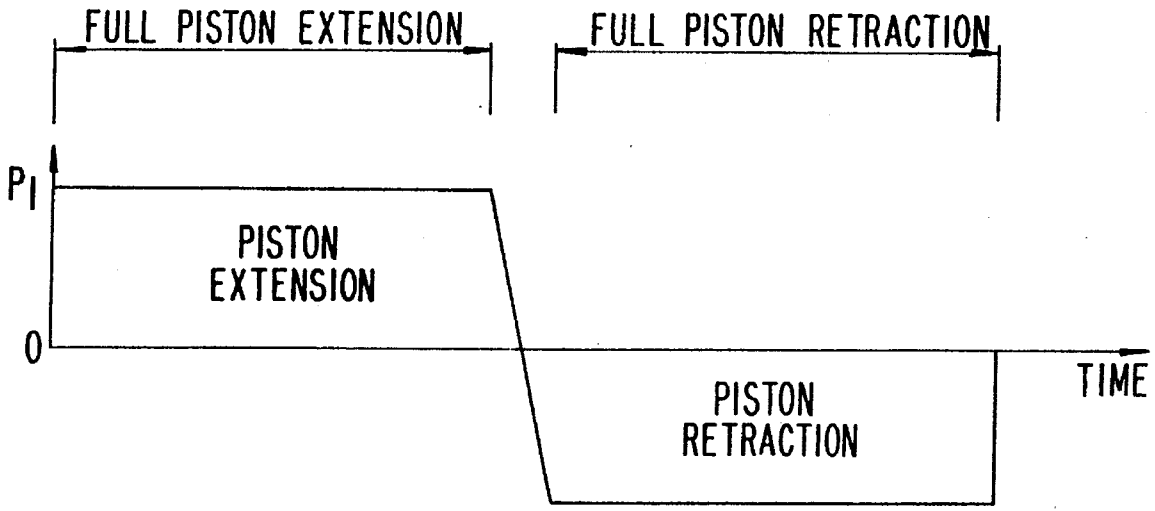
FIG. 7 is a graph of piston pressure versus time during a normal cleaning cycle.
Figure 8:
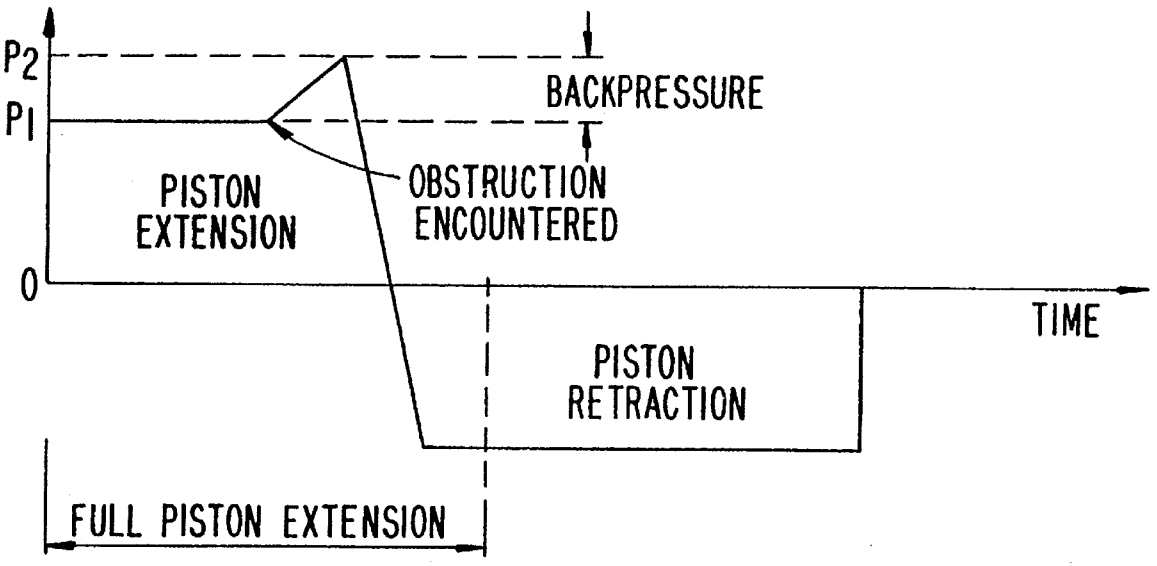
FIG. 8 is a graph analogous to FIG. 7, but during an obstruction encounter.

When the carriage is in the extended position, the limit switch 60 generates a trigger signal that advises the controller 88 to, among other things, close the valve 86, thereby resulting in no backpressure being detected on line 90. However, if the carriage encounters an obstruction during such travel to the extended position, then an increased backpressure $P_2$ (see FIG. 8) develops in line 90, and the backpressure sensor 92 will generate a backpressure signal before the limit switch 60 has triggered. This reversal in the order of arrival of the backpressure signal and the limit switch signal is recognized by the controller as an "obstruction" condition, as a result of which, the carriage is drawn immediately back to the retracted position. Compare FIGs. 7 and 8. The obstruction might be the user remaining seated on the toilet, but not applying any weight to the floor, or an object deliberately left on the toilet by a vandal and projecting above the seat.

An analogous situation exists if an obstruction is encountered during travel of the carriage from the extended to the retracted position, in which case, the backpressure sensor 98 will develop the increased backpressure signal before the limit switch 58 is received at the controller.

Once the washing and drying cycles are completed, the controller is re-set, and the cubicle is now ready for another user.

It will be understood that each of the elements described above, or two or more together, also may find a useful application in other types of constructions differing from the types described above.

While the invention has been illustrated and described as embodied in an arrangement for and method of automatically cleaning a sanitary fixture, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalents of the following claims.

What is claimed as new and desired to be protected by Letters Patent is set forth in the appended claims.

I claim:

1. An arrangement for cleaning a sanitary fixture, comprising:

a) an upright, generally planar, rear wall extending in a longitudinal direction rearwardly of the fixture;

b) a carriage mounted in the rear wall for reciprocal, translatory, linear movement in a direction generally perpendicular to the rear wall;

c) washing means mounted on the carriage for joint movement therewith and operative, when activated, for washing the fixture:

d) drying means mounted on the carriage for joint movement therewith and operative, when activated, for drying the washed fixture;

e) drive means for moving the carriage between a concealed position in which the carriage, the washing means and the drying means are concealed rearwardly of the rear wall, and an extended position in which the carriage, the washing means and the drying means are positioned above the fixture; and f) control means for sequentially activating the washing means and the drying means during said translatory movement.

2. The arrangement according to claim 1, wherein the carriage has a generally planar cover which is generally flush and co-planar with the rear wall in the concealed position.

3. The arrangement according to claim 2, wherein the rear wall has a beveled peripheral opening, and wherein the cover has a complementary beveled peripheral edge.

4. The arrangement according to claim 1, wherein the carriage includes a frame having arms telescopingly mounted on rails extending in said perpendicular direction.

5. The arrangement according to claim 1, where the washing means includes a plurality of nozzles for ejecting pressurized water at the fixture.

6. The arrangement according to claim 5, wherein one of the nozzles is situated forwardly along said perpendicular direction relative to the other nozzles.

7. The arrangement according to claim 1, wherein the drying means includes a duct for directing heated air at the fixture.

8. The arrangement according to claim 1, wherein the control means includes sensor means for detecting when the fixture is ready for cleaning, and for responsively activating the drive means to move the carriage from the concealed to the extended position, and limit means for detecting when the carriage has reached the extended position, and for responsively activating the drive means to move the carriage from the extended to the concealed position.

9. The arrangement according to claim 8; and further comprising safety means for detecting an obstruction against the carriage during movement from the concealed to the extended position, and for responsively activating the drive means to move the carriage back to the concealed position before the carriage reaches the extended position.

10. The arrangement according to claim 1, wherein the control means activates the washing means during a washing cycle in which the carriage is moved once to the extended position and returned to the concealed position, and wherein the control means sequentially activates the drying means during two drying cycles in which the carriage is moved twice to the extended position and returned to the concealed position.

11. A method of cleaning a sanitary fixture, comprising the steps of:

a) positioning an upright, generally planar, rear wall along a longitudinal direction rearwardly of the fixture;

b) mounting a carriage in the rear wall for reciprocal, translatory, linear movement in a direction generally perpendicular to the rear wall;

c) mounting a washer on the carriage for joint movement therewith;

d) mounting a dryer on the carriage for joint movement therewith;

e) translatorily moving the carriage between a concealed position in which the carriage, the washer and the dryer are concealed rearwardly of the rear wall, and an extended position in which the carriage, the washer and the dryer are positioned above the fixture; and f) activating the washer to wash the fixture, and sequentially activating the dryer to dry the washed fixture, during said translatory movement.

12. The method according to claim 11, wherein the step of activating the washer includes ejecting pressurized water at the fixture during said translatory movement.

13. The method according to claim 11, wherein the step of activating the dryer includes directing heated air at the fixture during said translatory movement.

14. The method according to claim 11; and further comprising the step of detecting when the fixture is ready for cleaning, and for responsively moving the carriage from the concealed to the extended position, and for subsequently responsively moving the carriage from the extended to the concealed position.

15. The method according to claim 14; and further comprising the step of detecting an obstruction against the carriage during movement from the concealed to the extended position, and for responsively moving the carriage back to the concealed position before the carriage reaches the extended position.

16. The method according to claim 11, wherein the step of activating the washer is performed during a washing cycle in which the carriage is moved once to the extended position and returned to the concealed position, and wherein the step of activating the dryer is performed during two drying cycles in which the carriage is moved twice to the extended position and returned to the concealed position.

* * * * *